United States Patent [19]

Watson

[11] Patent Number: 4,917,287

[45] Date of Patent: Apr. 17, 1990

[54] REVERSIBLE ENVELOPE

[76] Inventor: William W. Watson, 3585 Greenbrier, Apt. 75A, Ann Arbor, Mich. 48105

[21] Appl. No.: 343,629

[22] Filed: Apr. 27, 1989

[51] Int. Cl.[4] ..... B65D 27/06

[52] U.S. Cl. ..... 229/73

[58] Field of Search ..... 229/73

[56] References Cited

U.S. PATENT DOCUMENTS

| | | | |
|---|---|---|---|
| 1,373,512 | 4/1921 | Kuhhorn | 229/73 |
| 2,417,050 | 3/1947 | Baluk | 229/73 |
| 2,894,676 | 7/1959 | Lindeke | 229/73 |
| 2,910,222 | 10/1959 | Bermingham, Jr. et al. | |
| 3,111,257 | 11/1963 | Peach | 229/73 |
| 3,190,540 | 6/1965 | Shade | |
| 3,261,623 | 7/1966 | Kiedrowski | |
| 3,270,948 | 9/1966 | Donovan | |
| 3,558,040 | 1/1971 | Krueger | 229/73 |
| 3,874,582 | 4/1975 | Wang | |
| 3,908,892 | 9/1975 | Pelzer | |
| 4,044,942 | 8/1977 | Sherwood | |
| 4,089,418 | 5/1978 | Yale | |
| 4,089,419 | 5/1978 | Yale | |
| 4,157,759 | 6/1979 | Dicker | |
| 4,210,250 | 7/1980 | Yale | |
| 4,245,775 | 1/1981 | Conn | |
| 4,354,631 | 10/1982 | Stevenson | 229/73 |
| 4,565,317 | 1/1986 | Kranz | |
| 4,669,652 | 6/1987 | Sequin | |

*Primary Examiner*—Stephen P. Garbe

*Attorney, Agent, or Firm*—Dykema Gossett

[57] ABSTRACT

A reversible envelope is disclosed that has a front face, a rear face, two side tabs and a flap member with a removable cover. The arrangement of the various members is such that upon the construction of the first-use envelope, there will be no members within the envelope container that could hinder stuffing of the envelope. In addition, the construction of the envelope is such that there will be a minimum usage of paper and production steps to create the blank that is folded into the envelope. The reversible envelope of the invention is simple to use and can be explained with directions that are easy to follow.

3 Claims, 2 Drawing Sheets

REVERSIBLE ENVELOPE

BACKGROUND OF THE INVENTION

This invention relates to a reversible envelope, and more particularly to a reversible envelope that utilizes a minimum amount of paper, can be utilized by existing envelope stuffing machinery, and also ensures that the envelope will not be ripped when opened upon a first-use.

Reversible envelopes are utilized frequently in billing and related procedures. A common reversible envelope is first used to mail billing invoices or the like received within an envelope container. It is opened by a bill recipient and has a second-use as a return envelope so that the bill recipient will have an addressed envelope handy for returning a payment.

An example of a prior art reversible envelope is illustrated in U.S. Pat. No. 3,270,948 to Donovan. In this type of reversible envelope, the bill recipient's address is formed on one face, the return address of the bill sender is formed on another face, and there are two flap portions for overlying and sealing the envelope.

Problems arise with this type of envelope since there is normally excess material within the envelope container during stuffing of the first-use of the envelope. That is, there are parts that are not used in the first-use of the envelope that are necessary for the second-use of the envelope, and these parts are received within the envelope container. These extra parts that are received within the envelope container make it difficult for existing mail stuffing machines and the like to utilize these reversible envelopes. In the past, specialized machinery was required to stuff these types of envelopes, but of course this is undesirable and expensive. In addition, these types of reversible envelopes utilize more paper than is necessary, and when preparing a very large number of these envelopes, the manufacturing cost to arrive at the final envelope are affected by each additional piece of paper and portion of the envelope.

Frequently, the directions for using these envelopes have been complicated and difficult to follow.

It is therefore an object of the present invention to create a reversible envelope that will not have any extra portions within the envelope container at the time the first-use envelope is being stuffed.

Further, it is an object of the present invention to create a reversible envelope that utilizes a minimum number of sections and paper and is easy to use.

SUMMARY OF THE INVENTION

The present invention discloses a reversible envelope that will not have any extra portions within the envelope container when the envelope is stuffed for its first mailing.

The reversible envelope of the present invention comprises a rectangular front face with first and second side having two longitudinally extending edges of a first dimension and two laterally extending edges of a second dimension. A rectangular rear face with first and second sides has two longitudinally extending edges of the first dimension and two laterally extending edges of a third dimension smaller than the second dimension, one of the rear face longitudinally extending edges being integrally hinged to one of the front face longitudinally extending edges. Side tabs having first and second sides and two longitudinally extending edges of a fourth dimension shorter than the first dimension and two laterally extending edges of a dimension approximately equal, but slightly shorter than, the second dimension are integrally hinged to each lateral edge of the front face. This dimension is not shorter than the third dimension. Both sides of both the side tabs have glue disposed on their surface.

A flap member, having first and second sides, is integrally hinged to the longitudinally extending edge of the front face that is not hinged to the rear face. The flap is hinged at a longitudinally extending edge of the first dimension. The flap consists of a main portion with a lateral extent and a removable cover portion. The removable cover portion consists of a lower cover portion, a pull tab portion, and an upper cover portion wherein the lower cover portion is secured to a first glue strip disposed on the second side of the main portion of the flap member. The pull tab portion is connected to the lower cover portion along a serrated joint at the edge of the lower cover portion remote from the front face. The pull tab overlies a second glue strip. The upper cover portion is connected to the pull tab portion along a serrated joint formed at the edge of the pull tab remote from the first face. The upper cover portion extends laterally away from the first face beyond the lateral extent of the main portion of the flap. The upper cover portion has a third glue strip formed thereon on the first side of the flap member.

The hinges between the front face and the rear face, the side tabs, and the flap all allow pivotal movement in either direction.

The first side of the front face, the rear face, the side tabs and the flap is defined as the sides of the members facing in the same direction when all of these members are pivoted outwardly away from the front face.

This arrangement results in a reversible envelope in which the side tabs can be pivoted longitudinally inwardly to overlie a portion of the first side of the front face. The direction the front face first side faces is defined as a first direction. The second side of the side tab is now facing in the first direction, and the rear face is pivoted laterally inwardly such that the rear face first side overlies the side tab second side. The glue on the side tab second side secures the rear face first side at this pivoted position. The envelope container is now stuffed for a first-use.

This first-use of the reversible envelope will not have any unnecessary portions in the envelope container. A standard stuffing machine will be able to stuff a mailing, such as an invoice, into this envelope as if it were a normal, non-reversible envelope.

The flap is now pivoted laterally inwardly such that the flap second face faces the first direction, and the flap first side overlies the rear face second side. The third glue strip secures the rear face, thus sealing the first-use of the reversible envelope.

The pull tab is removable from the upper and lower covers to separate the pull tab and expose the second glue strip. Upon separation of the pull tab, the upper cover remains secured to the rear face. The flap is released from the rear face allowing access to the envelope container.

The rear face can then be separated from the side tabs. Preferably the second side of the side tabs is covered with small discrete dots of glue to make this separation easier.

In order to use the envelope a second time, the side tabs are pivoted longitudinally inwardly over the second side of the front face, and the second side of the rear face is then pivoted laterally inwardly to overlie these side tabs and to be secured by the glue on the first side of the side tabs. The bill recipient would now place his return documents in the envelope container. The second side of the flap may now be pivoted laterally inwardly, and the second glue strip that was covered by the pull tab can now secure the rear face first side, thus creating the second-use of the reversible envelope.

The reversible envelope of this invention is thus relatively easy to use. The directions for the use of the second-use envelope are rather easy to follow.

Further objects and features of the present invention can be best understood in conjunction with the following specification and appended drawings, of which the following is a brief description thereof.

DESCRIPTION OF A PREFERRED EMBODIMENT

Figure 1:
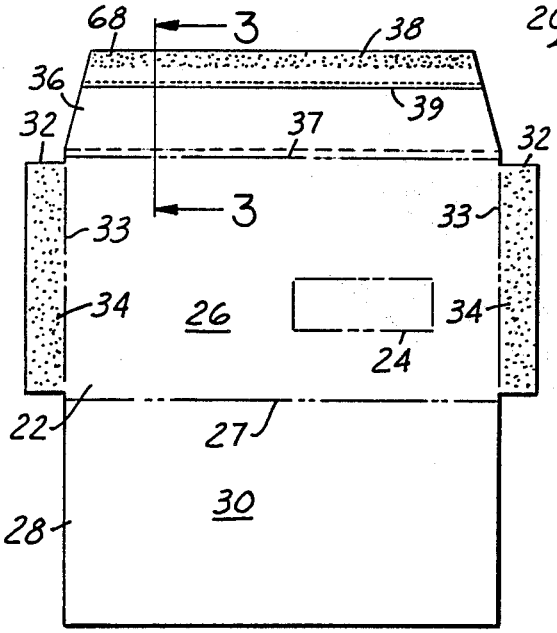
FIG. 1 shows the first side of the reversible envelope of the present invention.
Figure 2:
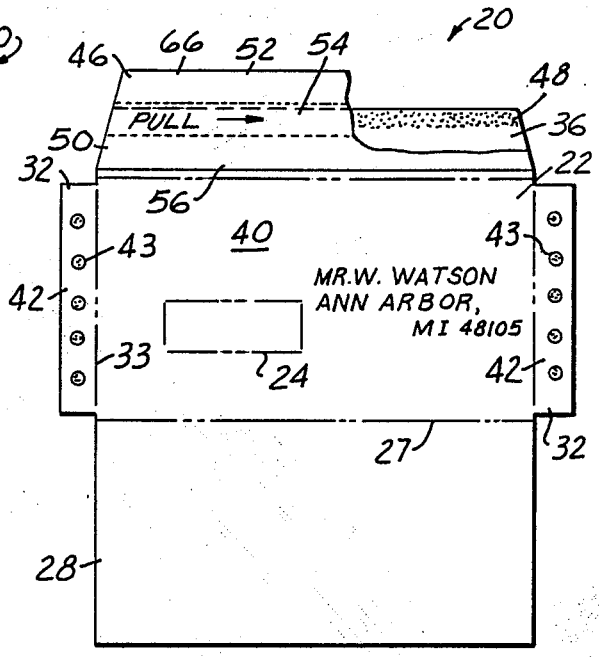
FIG. 2 shows the second side of the reversible envelope of the present invention.
Figure 3:
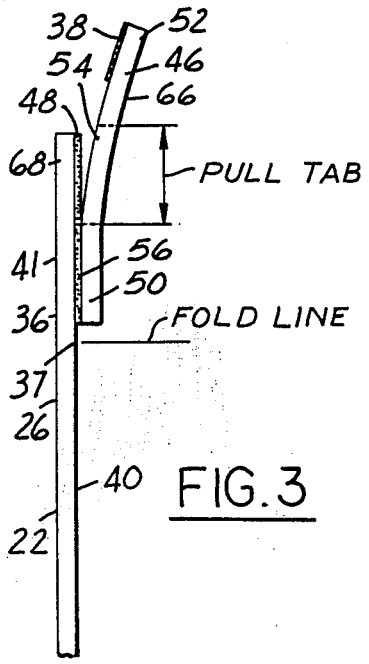
FIG. 3 is a cross-section through the flap member of the present invention.

The general structure of the reversible envelope of the present invention can be best understood from FIGS. 1–3. As shown in FIG. 1, a reversible envelope 20 has a front face 22, that may optionally have a cut window opening 24 formed therein, and has a first side 26. Front face 22 is connected at a hinge 27 to rear face 28. Hinge 27 will allow the pivoting of rear face 28 either into or out of the paper as illustrated in FIG. 1 with respect to front face 22. A first side 30 of the rear face 28 is illustrated in FIG. 1. Side tabs 32 are disposed on both lateral sides of front face 22, and tab hinge joints 33 connect the two members along a lateral edge of the front face 22. Side tabs 32 have a first face 34 with glue covering them. A flap of the envelope consists of a main portion 36 that is hinged at 37 to a longitudinally extending edge of front face 22. Front face 22 has two longitudinally extending edges of a first dimensions, one of which is hinged 27 to a longitudinally extending edge of rear face 28 and the other being hinged 37 to flap 36. The longitudinally extending edges of the front face 22, the rear face 28 and the flap 36 are all of a first dimension. The laterally extending edges of front face 22 are of a second dimension that is greater than the lateral dimension of rear face 28 and only slightly greater than the lateral dimension of side tabs 32.

A glue edge 38 is shown at the uppermost portion of the flap 36 remote from the front face 22. The lateral extent of glue strip 38 is illustrated at 39. A first side 68 of flap 36 is illustrated in FIG. 1.

The first sides of front face 22, rear face 28, side tabs 32 and flap member 36 are defined as the side that is illustrated facing upwardly in FIG. 1. A first use envelope can be arrived at by pivoting all four of the members that are attached to front face 22 outwardly away from front face 22.

A second side of the various members is illustrated in FIG. 2. FIG. 2 illustrates second side 40 of front face 22 that is connected to a second side 42 of the side tabs 32. Second side 42 of the side tabs 32 has small discrete glue dots 43 formed thereon. The second side 44 of rear face 28 is attached to the first side of front face 22 at the same hinge joint 27. A removable cover portion 46 of flap 36 is shown with a cutaway portion exposing a glue strip 48. Cover portion 46 consists of a lower cover portion 50, an upper cover portion 52, and an intermediate pull tab 54. Upper cover portion 52 and lower cover portion 50 are each attached to pull tab 54 along a serrated edge to ensure that pull tab 54 will be easily separable from the two cover members 50, 52. This is the second side 66 of flap 36.

The structure of flap member 36 can be better understood from the cross-sectional view illustrated in FIG. 3. As shown in FIG. 3, flap 36 is attached to front face 22 at hinge 37. First side 68 of flap member 36 is illustrated as the side of the flap 36 that does not receive removable cover member 46, which is received on the second side 66 of flap 36. As illustrated in FIG. 3, glue strip 38 is formed on the upper cover portion 52 and is above the lateral extent of the main portion 41 of flap 36. As can also be seen in FIG. 3, pull tab 54 overlies a glue strip 48, while lower cover member 50 is secured to main portion 41 of flap 36 by glue strip 56.

It is to be understood that glue strip 56 secures the removable cover member 46 to the main portion 41 by attaching the lower cover member 50 to the main portion 41. Pull tab 54 simply overlies glue strip 48 and protects it from being activated prior to its being used.

Figure 4:
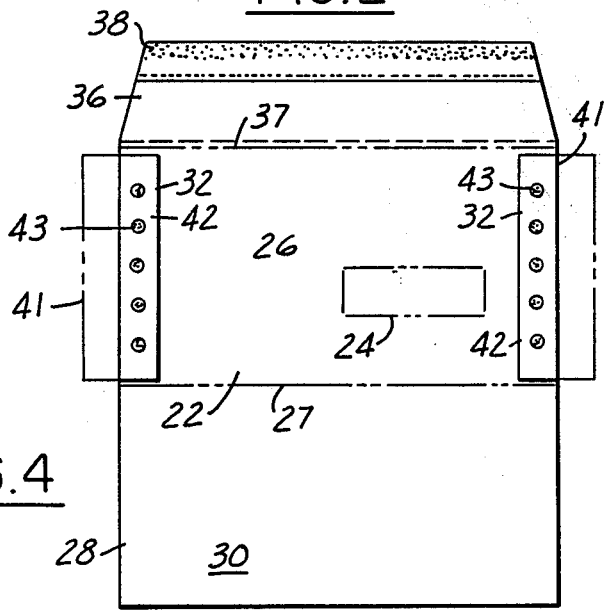
FIG. 4 shows a first step in folding the first-use envelope of the present invention.

The construction of a first-use envelope of the present invention will now be described with reference to FIGS. 4-7. As shown in FIG. 4, side tabs 32 are pivoted longitudinally inwardly to overlie the first side 26 of front face 22. The second sides 42 of the side tabs 32 are now facing in a first direction defined as the same direction first side 26 of front face 22 is facing. Small glue dots 43 are formed on the second side 42.

Figure 5:
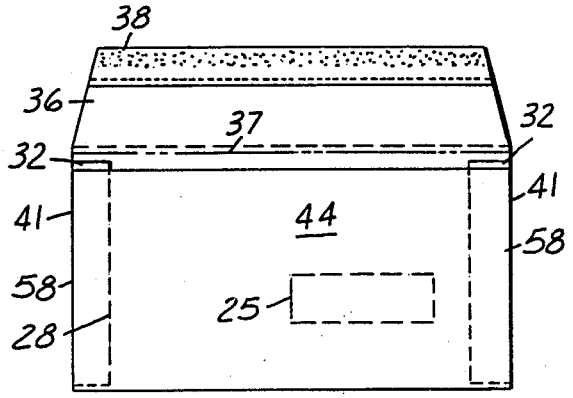
FIG. 5 shows a second intermediate step in folding the first-use envelope of the present invention.

FIG. 5 illustrates the second step in the construction of the first-use envelope. The rear face 28 is now pivoted laterally inwardly to overlie side tabs 32. As can be seen, rear face 28 does not extend to the same lateral extent as front face 22. Thus, there is a clearance above the end of the rear face which makes stuffing of the envelope easier. Glue dots 43 secure rear face 28 to side tabs 32 such that an envelope container is now constructed. Side joints 58 are defined as the joint between side tabs 32 and rear face 28. As can be seen in FIG. 5, the second side 44 of rear face 28 now faces in the first direction.

The envelope container can now be stuffed. The recipient's address may be printed on the second side 40 of front face 22.

Figure 6:
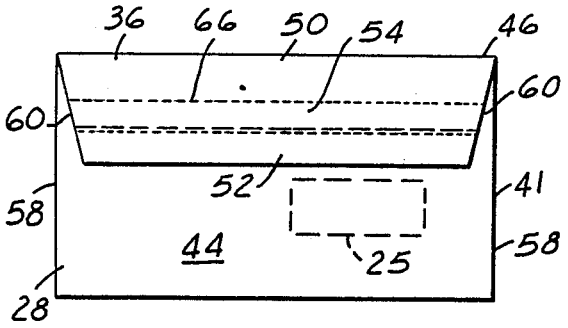
FIG. 6 shows one side of the closed first-use envelope of the present invention.

The closure of the first-use envelope is shown in FIG. 6. Glue strip 38 is now activated by any glue activation means, and it is pivoted laterally inwardly to overlie and secure rear face 28 on side 44. A flap joint 60 is defined as the joint between flap 36 and rear face 28 on side 44. Thus, the second side 66 of flap 36 is now facing the first direction, and a complete envelope has now been formed. The optional cut window opening would be facing into the paper in FIG. 6; however, it is shown in phantom at 25 so as to help the reader in orienting the various members of the reversible envelope 20.

Figure 7:
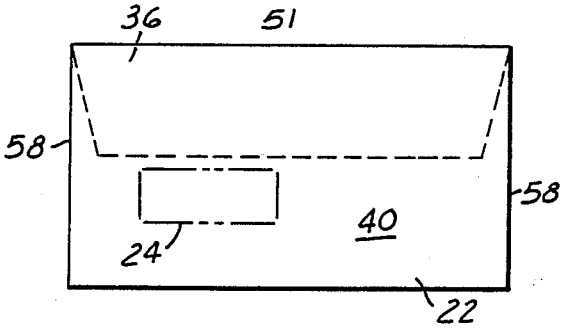
FIG. 7 shows the reverse side of the closed envelope illustrated in FIG. 6.

FIG. 7 shows the first-use envelope illustrated to FIG. 6 from the reverse side. Second side 40 of front face 22 has the cut window opening 24 formed optionally therein.

Figure 8:
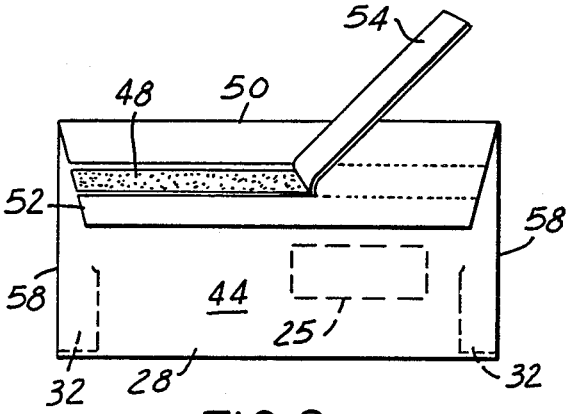
FIG. 8 shows the removal of the pull tab to open the first-use envelope of the present invention.

This flat-use envelope is now mailed to a recipient. When the recipient receives the envelope, he will first pull off pull tab 54, as illustrated in FIG. 8. Pull tab 54 is torn away from both lower cover member 50 and upper cover member 52. The flap 36 can now be opened. Upper cover portion 52 remains glued to the rear face 28 of the first-use envelope. At the same time, removal of the pull tab 54 exposes a glue joint 48 that will be the sealant for the second-use envelope of the reversible envelope 20.

Figure 9:
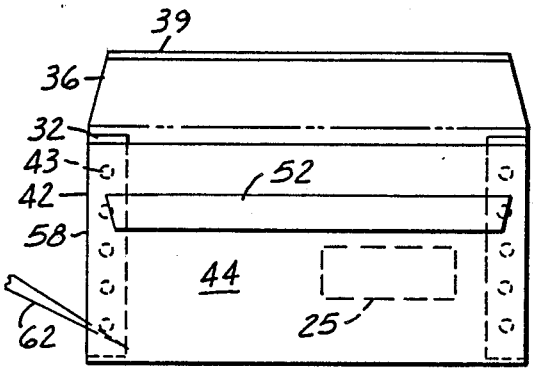
FIG. 9 shows the separation of the side tabs and the rear face of the first-use envelope of the present invention.

As shown in FIG. 9, a tool 62, such as a letter opener, is next inserted into side joints 58, and the glue dots 43 are broken away to release rear face 28 from side tabs 32. Alternatively, a finger may be used. Once this has been accomplished, the reversible envelope 20 of the present invention will be returned to the shape illustrated in FIGS. 1 and 2, other than the absence of upper cover portion 52.

Figure 10:
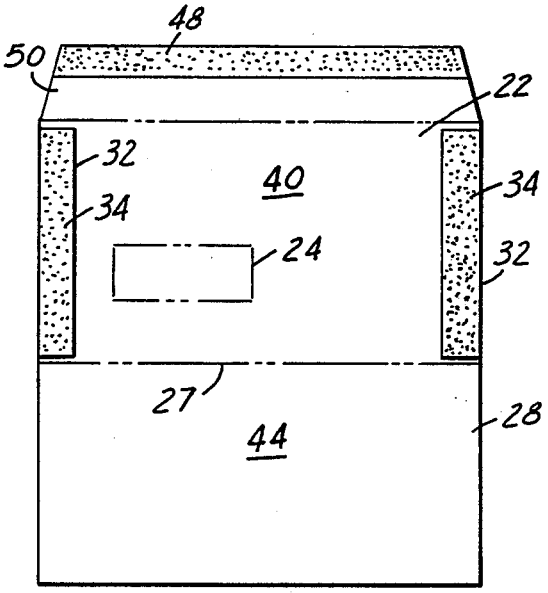
FIG. 10 shows a first intermediate step in creating the second-use envelope of the present invention.

With reference now to FIG. 10, the second-use envelope of the present invention will be described. Once the recipient has opened the first-use envelope, the same envelope can be used as a return envelope.

It is to be understood that the sender of the first-use envelope will typically place the recipient's address on the second side 40 of the front face 22 and the sender's return address on the first side 26 of the front face 22. When using the cut window opening 24, the recipient's address is printed on the documents stuffed in the envelope container.

When constructing the second-use envelope of the present invention, the side tabs 32 are pivoted longitudinally inwardly over the second side 40 of front face 22. The first side 34 of side tabs 32 is now facing outwardly away from front face 22. First side 34 of end tabs 32 will preferably be completely covered with glue to provide a secure side joint.

Figure 11:
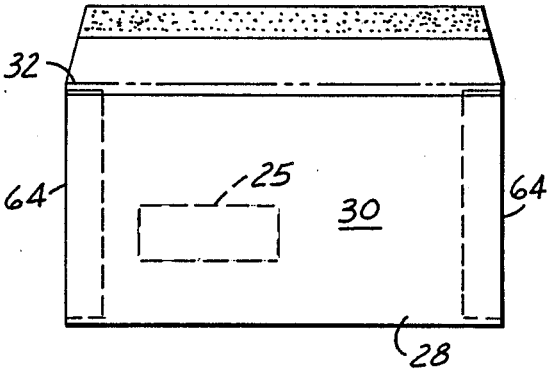
FIG. 11 shows a second intermediate step in the creation of the second-use envelope of the present invention.

As illustrated in FIG. 11, rear face 28 is pivoted laterally inwardly such that the second side 44 of the rear face 28 will overlie the first side 34 of the side tabs 32 and be sealed by the glue on the side tabs. The envelope container is now formed and can receive return documents. At this point, the flap 36 is pivoted laterally inwardly, and the glue joint 48 used to seal the second-use envelope.

A preferred embodiment of the present invention has been disclosed; however, it is to be understood that a worker in the art would appreciate that certain modifications would be within the scope of this invention. Therefore, reference should be had to the following claims to determine the true scope of the present invention.

I claim:

1. A reversible envelope comprising a rectangular front face with a first and second side having two longitudinally extending edges of a first dimension and two laterally extending edges of a second dimension;

a rectangular rear face with a first and second side having two longitudinally extending edges of said first dimension and two laterally extending edges of a third dimension shorter than said second dimension, one of said rear face longitudinally extending edges being integrally hinged to one of said front face longitudinally extending edges;

side tabs having first and second sides and having two longitudinally extending edges extending for a fourth dimension, shorter than said first dimension, and two laterally extending sides of a dimension approximately equal to but slightly shorter than said second dimension, both of said tabs having one of said laterally extending edges being integrally hinged to one of said front face laterally extending edges, such that each of said two laterally extending edges of said front face has an integrally attached tab, both of said tabs having glue disposed on both of said sides;

a flap with first and second sides having a longitudinally extending edge of said first dimension and being integrally hinged to the other of said longitudinally extending edges of said front face, said flap having a main portion with a lateral extent and a removable cover portion consisting of a lower cover portion, a pull tab portion, and an upper cover portion, said lower cover portion secured to a first glue strip disposed on said second side of said main flap portion, said pull tab portion being connected to said lower cover portion along a serrated joint at the end of said lower cover portion remote from said front face, said pull tab portion overlying a second glue strip, said upper cover portion being connected to said pull tab portion along a serrated joint at the end of said pull tab remote from said front face, said upper cover portion extending laterally away from said front face beyond said lateral extent of said flap main portion, said upper cover portion having a third glue strip formed thereon on said flap first side; and said hinges between said front face and said rear face, said side tabs, and said flap all allowing pivotal movement in both directions, said first side of said front face, said rear face, said side tabs and said flap all facing in a first direction when all of these said members are pivoted outwardly away from said second side of said front face, thus resulting in a reversible envelope such that said side tabs can be pivoted longitudinally inwardly to overlie a portion of said first side of said front face, said second side of said side tabs now facing said first direction, said rear face being pivoted laterally inwardly such that said rear face first side overlies said side tabs second side, said glue on said side tab second side securing said rear face first side at this pivoted position, an envelope container now being defined for receiving documents, said flap being pivoted laterally inwardly such that said flap second face faces said first direction and said flap first side overlies said rear face second side, said third glue strip securing said rear face, thus resulting in a closed first-use envelope, said pull tab being removable from both of said upper and lower covers to separate said pull tab, exposing said second glue strip upon removal, said third glue strip and said upper cover portion remaining secured to said rear face, said rear face being separable from said side tabs, the reversible envelope being such that said side tabs can be pivoted longitudinally inwardly over said second side of said front face, said second side of said rear face can be pivoted laterally inwardly to overlie said side tabs and can be secured thereto, said first side of said flap can be pivoted laterally inwardly to overlie said rear face and said second glue strip can secure said flap to said first side of said rear face, to provide a closed second-use envelope.

2. A reversible envelope as recited in claim 1, and wherein a cut window opening is formed in said front face.

3. A reversible envelope as recited in claim 1, and wherein said glue on said side of said side tabs being disposed in discrete dots.

* * * * *